US005725128A

United States Patent [19]

Foster

[11] Patent Number: 5,725,128

[45] Date of Patent: Mar. 10, 1998

[54] MANUALLY OPERATED RECIPROCATING LIQUID PUMP THAT LOCKS AND SEALS IN UP AND DOWN POSITIONS

[75] Inventor: Donald D. Foster, St. Charles, Mo.

[73] Assignee: Contico International, Inc., St. Louis, Mo.

[21] Appl. No.: 612,667

[22] Filed: Mar. 8, 1996

[51] Int. Cl.[6] ..... B67B 5/00

[52] U.S. Cl. ..... 222/153.13; 222/321.9

[58] Field of Search ..... 222/153.13, 321.7, 222/321.8, 321.9, 153.14

[56] References Cited

U.S. PATENT DOCUMENTS

| | | |
|---|---|---|
| 3,797,705 | 3/1974 | Cooprider . |
| 3,827,605 | 8/1974 | Knickerbocker . |
| 3,827,606 | 8/1974 | Knickerbocker . |
| 4,162,746 | 7/1979 | Anderson et al. . |
| 4,286,736 | 9/1981 | Corsette . |
| 4,318,498 | 3/1982 | Magers et al. . |
| 4,340,158 | 7/1982 | Ford et al. . |
| 4,355,962 | 10/1982 | Magers . |
| 4,368,830 | 1/1983 | Soughers . |
| 4,369,899 | 1/1983 | Magers et al. . |
| 4,375,266 | 3/1983 | Magers . |
| 4,384,660 | 5/1983 | Palmisano et al. . |
| 4,424,919 | 1/1984 | Knox et al. . |
| 4,479,589 | 10/1984 | Ford . |
| 4,496,085 | 1/1985 | Ford et al. . |
| 4,512,501 | 4/1985 | Foster . |
| 4,538,748 | 9/1985 | Ford et al. . |
| 5,405,057 | 4/1995 | Moore ..... 222/321.9 X |
| 5,445,299 | 8/1995 | Harriman . |

*Primary Examiner*—Gregory L. Huson
*Attorney, Agent, or Firm*—Howell & Haferkamp, L.C.

[57] ABSTRACT

On a manually operated reciprocating liquid pump, comprising a plunger mounted for reciprocating movement between charge and discharge positions in a pump housing, a lock mechanism on the pump selectively locks the plunger in its charge and discharge positions relative to the pump housing. Seals are also provided that prevent leakage through the pump when the plunger is in its charge and discharge positions.

30 Claims, 3 Drawing Sheets

MANUALLY OPERATED RECIPROCATING LIQUID PUMP THAT LOCKS AND SEALS IN UP AND DOWN POSITIONS

BACKGROUND OF THE INVENTION

1. Field of the Invention

The subject matter of the application pertains to a manually operated reciprocating liquid pump that comprises a pump plunger that reciprocates vertically in a pump housing. The inventive subject matter of the application pertains to a locking mechanism on the pump and seals that prevent leakage through the pump. The locking mechanism locks the plunger to the pump housing in both its upwardly extended and downwardly inserted positions relative to the pump housing, and the seals prevent leakage through the pump in both the up and down positions of the plunger relative to the pump housing.

2. Description of the Related Art

Manually operated reciprocating liquid pumps typically employ a plunger that is manually reciprocated downwardly into a pump housing and is then spring biased upwardly out of the pump housing. The pump housing is connected to a liquid container and the pump draws liquid out of the container on the upward movement of the plunger relative to the pump housing. The liquid drawn out of the container into the pump housing on upward movement of the plunger is then pumped out of the plunger on the subsequent downward movement of the plunger relative to the pump housing.

Because the amount of liquid dispensed from manually reciprocating pumps is dependent on the size of the reciprocating stroke of the plunger in the pump housing, in pumps of this type having larger liquid outputs the plunger extends a significant distance from the pump housing when in its upward extended position relative to the housing. In order to reduce the vertical size of these pumps when shipped, many prior art pumps are provided with a locking mechanism that locks the plunger in its down position relative to the pump housing with the majority of the plunger length inserted into the pump housing.

When a pump of this type is used to dispense a product, such as hand lotion, at times it is necessary to move the plunger to its downward locked position. For example, when a producer of hand lotion packages its product in a bottle to be dispensed by a pump of this type, the pump will be assembled onto the bottle after the bottle has been filled with a specified weight of the product. If the pump is assembled to the bottle with the plunger in its extended position relative to the pump housing, it will be necessary to move the pump to its downward inserted position relative to the pump housing to reduce the overall size of the pump and container for shipping. Moving the plunger downwardly to its locked position after its attachment to the liquid container often causes a portion of the liquid to be pumped and dispensed through the pump housing, with the undesirable result of reducing the net weight of the product contained in the container prior to its shipment. The dispensing of small amounts of the product from each pump on the production line can also have the undesirable effect of producing down time on the line in order to clean up the dispensed product and remove it from the area. The consumer of the product will also often find it necessary to lock the plunger in its downwardly inserted position relative to the pump housing. For example, when packing a bottle of hand lotion in luggage, it would be desirable to move the plunger to its downwardly locked position to limit the space occupied by the bottle and plunger in the luggage and also to prevent the unintended leakage of product while packed in the luggage. Moving the plunger to its downward position so that it can be locked results in the unintended dispensing of a small portion of the product often wasting that portion of the product.

It is an object of the present invention to provide a novel construction of a manually operated reciprocating liquid pump comprising a plunger that locks relative to the pump housing in the upwardly extended position of the plunger as well as the downwardly inserted position of the plunger relative to the pump housing. Additionally, it is also an object of the present invention to provide a novel construction of a manually operated reciprocating liquid pump in which the pump seals in both the upwardly extended position of the plunger and the downwardly inserted position of the plunger relative to the pump housing.

SUMMARY OF THE INVENTION

The manually operated reciprocating liquid pump of the invention is basically comprised of a pump housing, a plunger received in the housing for reciprocating movement, and a lock mechanism mounted on the housing and surrounding the plunger.

The pump housing has a cylindrical configuration with an interior bore extending through the housing between a top end and a bottom end of the housing. A portion of the interior bore is occupied by a pump chamber. A small liquid inlet opening is provided at the bottom of the pump chamber and a ball check valve is positioned below the inlet opening. A dip tube extends from the lower end of the pump housing into the liquid container below the check valve. An opening is provided at the top of the pump housing for receipt of the plunger.

The plunger also has a cylindrical configuration with a hollow interior bore. The plunger is dimensioned to be received for reciprocating movement in the interior bore of the pump housing. Upper and lower annular shoulders are provided on the plunger exterior and are axially spaced from each other. The shoulders are selectively engaged by the lock mechanism to lock the plunger in the upward or downward position relative to the pump housing. A dispenser head is connected at the top end of the plunger and a sealing plug is formed at the bottom end of the plunger. The sealing plug is shaped to seat over and seal close the inlet opening of the pump housing when the plunger is moved downwardly to its discharge position relative to the pump housing. Liquid outlet openings are provided through the plunger lower end communicating the pump housing interior with the interior bore of the plunger.

A piston is mounted on the lower end of the plunger for limited vertical movement of the piston relative to the plunger. The piston has a sealing ring that extends around the plunger lower end. The piston is movable between two positions relative to the outlet openings. In the lowermost position it seals closed communication between the pump housing interior and the plunger interior, and at the upper position of the piston relative to the plunger it opens fluid communication from the pump housing interior through the outlet openings into the plunger interior bore. On upward movement of the plunger toward the charge position of the plunger relative to the housing, the piston moves to its lower position and seals closed liquid communication between the pump chamber and the plunger interior bore. On downward movement of the plunger toward the discharge position of the plunger, the piston moves upwardly to open liquid communication between the pump chamber and the plunger interior bore.

In the first embodiment of the invention a spring is positioned between the pump chamber lower end and the plunger lower end and biases the plunger toward its upward or charge position relative to the pump housing.

In a second embodiment of the liquid pump, the spring is positioned around the plunger outside of the flow path of liquid pumped through the pump.

The lock mechanism is mounted on the upward end of the pump housing and surrounds the plunger. The lock mechanism has a plurality of pawls that are mounted to the mechanism by leaf springs. The springs bias the pawls away from the exterior surface and the upper and lower shoulder abutments of the plunger. A cam ring surrounds the lock mechanism and is mounted to the top of the pump housing for rotation relative to the housing. On rotation of the cam ring in one direction, cams engage the pawls and move the pawls into sliding engagement against the exterior surface of the plunger where they engage and lock against the upper and lower shoulders of the plunger. When the pawls engage the lower shoulder of the plunger they lock the plunger in its upwardly extended or charge position relative to the pump housing. When the pawls engage the upper shoulder of the plunger they lock the plunger in its downwardly inserted or discharge position relative to the pump housing. Rotation of the cam ring in the opposite direction disengages the cams from the pawls and the pawls move away from the exterior surface of the plunger by the resilience of their leaf springs. The plunger is then free to reciprocate between its downward or discharge position relative to the housing and its upward or charge position relative to the housing.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENTS

Figure 1:
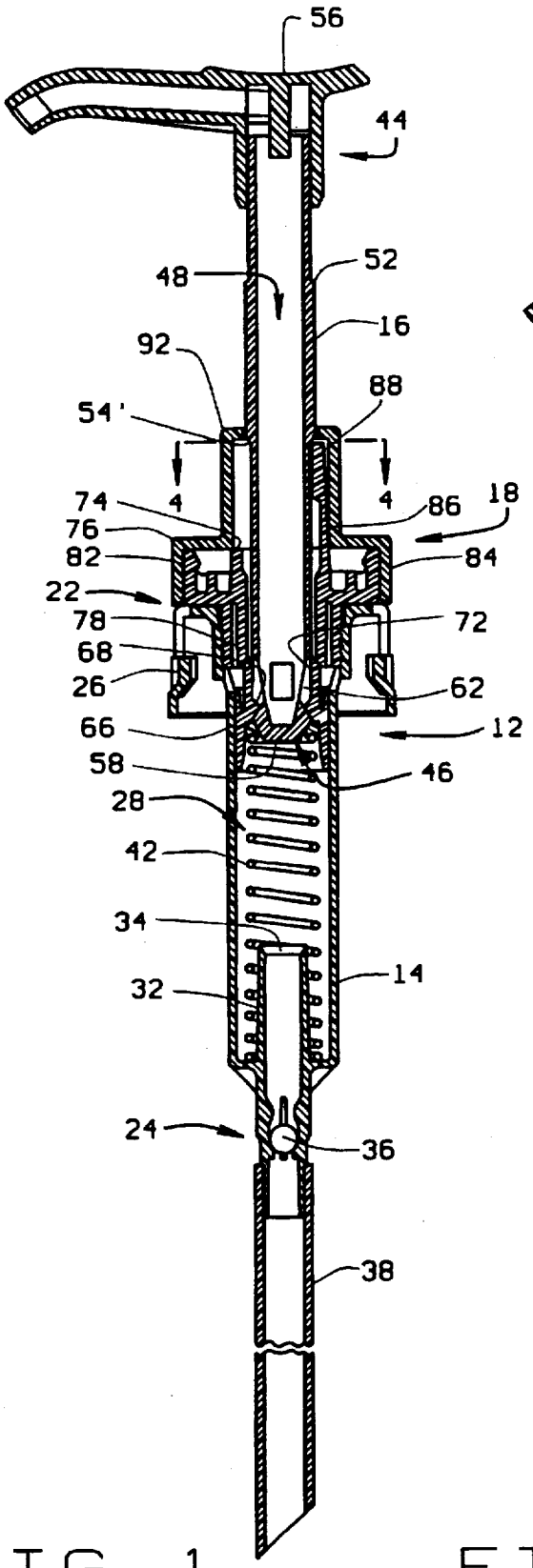
FIG. 1 is an in section elevation view of the pump of the invention in its upwardly extended or charge position.

FIG. 1 shows a first embodiment of a manually operated reciprocating liquid pump incorporating the inventive subject matter of the application. Although the subject matter of the invention is described as being applied to a manually operated reciprocating liquid pump in which the pump plunger reciprocates vertically relative to the pump housing in usual operation, the subject matter of the invention is also equally well suited for use on other types of manually operated pumps such as trigger sprayer pumps. It should be understood that the operative environment of the particular types of pumps shown in the drawing figures are illustrative only and are not intended to be limiting on the subject matter of the invention.

The manually operated reciprocating liquid pump 12 of the invention is basically comprised of a pump housing 14, a plunger 16 received in the pump housing for reciprocating movement relative thereto, and a lock mechanism 18 mounted on the pump housing and surrounding the plunger. The plunger is also provided with seals that seal close liquid communication through the pump in both the upwardly extended, charge position and downwardly inserted, discharge position of the plunger relative to the pump housing.

The pump housing 14 has a general cylindrical configuration with opposite top 22 and bottom 24 ends and a hollow interior bore extending completely through the housing between its opposite ends. The top end 22 of the housing is formed with a connector 28 for connecting the liquid pump to a liquid container. The connector 28 shown is a bayonet-type snap on connector, however, a screw threaded cap may also be employed as the connector.

Below the connector 28 the interior bore of the pump housing is formed as a pump chamber 28. At the bottom of the pump chamber is a column 32 extending upwardly from the pump chamber floor. The column has a liquid inlet opening 34 at its top that conducts liquid into the pump chamber from the column. Contained inside the column 32 and below the pump chamber 28 is a ball check valve 36. The ball check valve 36 permits liquid flow through the column 32 into the pump chamber 28, but prevents the reverse flow of liquid from the pump chamber through the column. Connected to the lower most end of the column 32 below the check valve 36 is a dip tube 38. The dip tube extends to the bottom of the liquid container when the pump 12 is attached to the container and conducts liquid from the container to the interior of the pump housing.

A coil spring 42 is contained in the pump chamber 28 of the pump housing. The coil spring has a coil diameter slightly larger than the column 32 so that it passes over the column and rests on the bottom of the pump chamber.

The plunger 16 passes through the top of the pump housing 14 and into the pump chamber 28. The plunger has a generally cylindrical configuration with opposite top 44 and bottom 46 ends and an interior bore 48 extending through the plunger between its opposite ends. The plunger has a substantially continuous cylindrical surface between its opposite ends except for an upper annular shoulder 52 and a lower annular shoulder 54 that surround the plunger exterior surface. The upper shoulder is spaced from the lower shoulder and the distance between the two shoulders corresponds roughly to the distance of the plunger stroke in the pump housing. The exterior cylindrical surface of the plunger is substantially continuous between the upper and lower shoulders. A dispensing head 56 is attached to the top 44 of the plunger, and a sealing plug 58 is attached to the bottom 46 of the plunger. The sealing plug 58 has a periphery that is configured and dimensioned to seat in sealing contact over the liquid inlet opening 34 at the top of the column 32, thus sealing the opening closed. The plug 58 seats over the inlet opening 34 when the plunger is moved to its inwardly inserted, discharge position relative to the pump housing 14. The coil spring 42 engages against the plug 58 at the upper end of the spring and biases the plunger 16 to its upwardly extended, charge position shown in FIG. 1. A plurality of outlet openings 62 extend through the bottom of the plunger just above the sealing plug 58. The outlet openings conduct liquid out of the pump chamber 28 and into the plunger interior bore 48.

Figure 2:
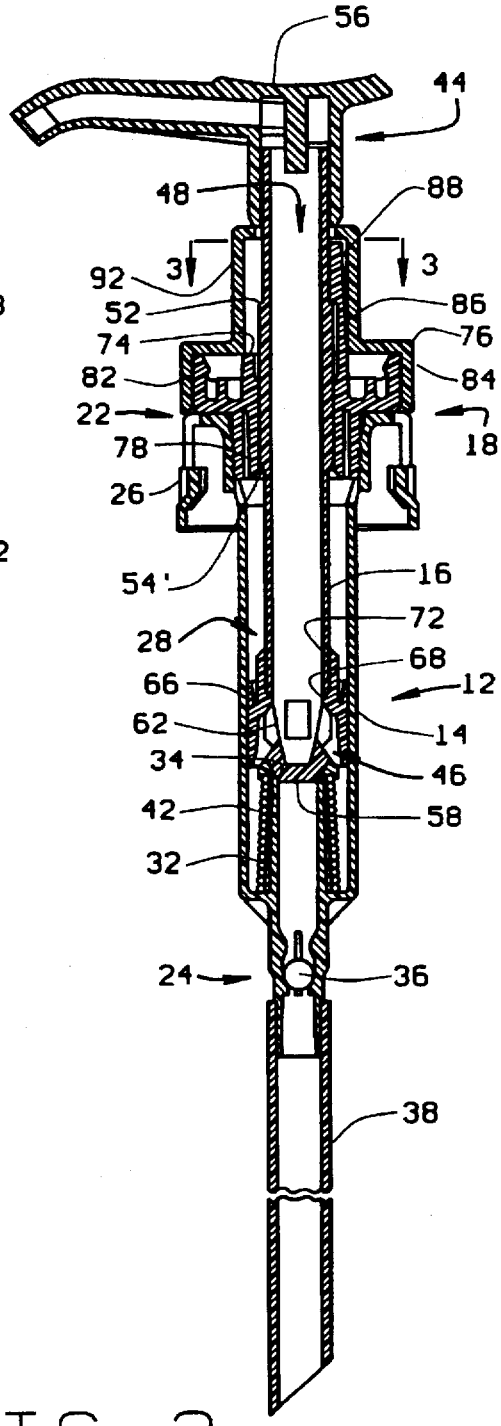
FIG. 2 is an in section view of the pump of FIG. 1 in its downwardly inserted, discharge position.

A piston 66 is mounted on the lower end of the plunger 16 and engages in sliding contact with the interior surface of the pump chamber 28. The piston 66 is mounted on the lower end of the plunger 12 by an annular seal ring 68 that engages around the outlet openings 62 of the plunger. The mounting of the seal ring 68 over the plunger openings 62 allows the ring to move for a limited axial distance over the plunger. The ring may move from the lower ends of the outlet openings 62 shown in FIG. 1, to the upper ends of the outlet openings as shown in FIG. 2. This limited axial movement of the seal ring 68 is caused by the plunger 16 moving the piston 66 downwardly in the pump chamber 28 on a discharge stroke of the plunger, and upwardly in the pump chamber on a charge stroke of the plunger. When the seal ring 68 is positioned at the bottom ends of the outlet openings 62 as shown in FIG. 1, it prevents fluid communication between the pump chamber 28 and the plunger interior bore 48. When the seal ring 68 moves upwardly to where it engages the tops of the outlet openings 62 as shown in FIG. 2, it permits liquid communication between the pump chamber 28 and the plunger interior bore 48. A seal band 72 extends upwardly from the seal ring 68 and overlaps a small portion of the exterior surface of the plunger. The seal band 72 prevents liquid from exiting the plunger interior bore 48 on the upward charge stroke of the plunger by engaging over and closing the outlet openings 62 as shown in FIG. 1.

The lock mechanism 18 is comprised of a base 74 and a lock ring 76. The lock base 74 has a pair of concentric lower annular flanges 78 and an upper annular flange 82. The innermost of the lower annular flanges engages against the seal band 72 of the piston with the plunger moved to its upwardly extended, charge position. This engagement of the inner flange holds the piston in its downward position relative to the plunger and holds the seal ring 68 of the piston in engagement around the plunger sealing plug 58. This seals closed the outlet openings and ensures no leakage of liquid between the pump chamber 28 and the plunger interior bore 48. The outermost of the lower annular flanges 78 has circular ribs on its exterior surface that engage with complimentary shaped ribs on an interior surface of the connector 26. This securely fastens the lock base 74 to the top of the connector. The upper annular flange 82 has an exterior peripheral surface that is engaged in sliding contact by an inner surface of a circular collar 84 at the bottom of the lock ring 76. The engagement of the lock ring collar 84 over the upper annular flange 82 connects the lock ring 76 to the lock base 74 for relative rotational movement.

Figure 3:
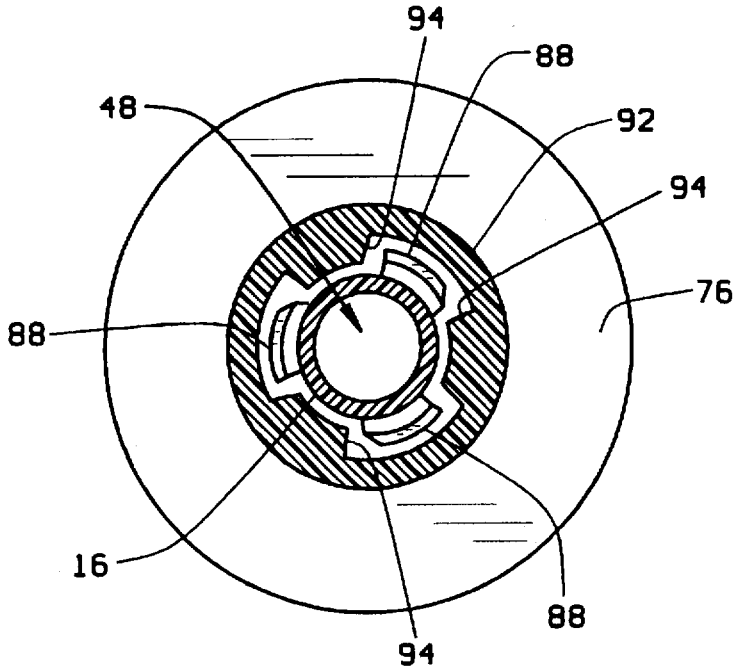
FIG. 3 is a cross section view of the lock mechanism of the pump of FIG. 1 shown in its unlocked condition.
Figure 4:
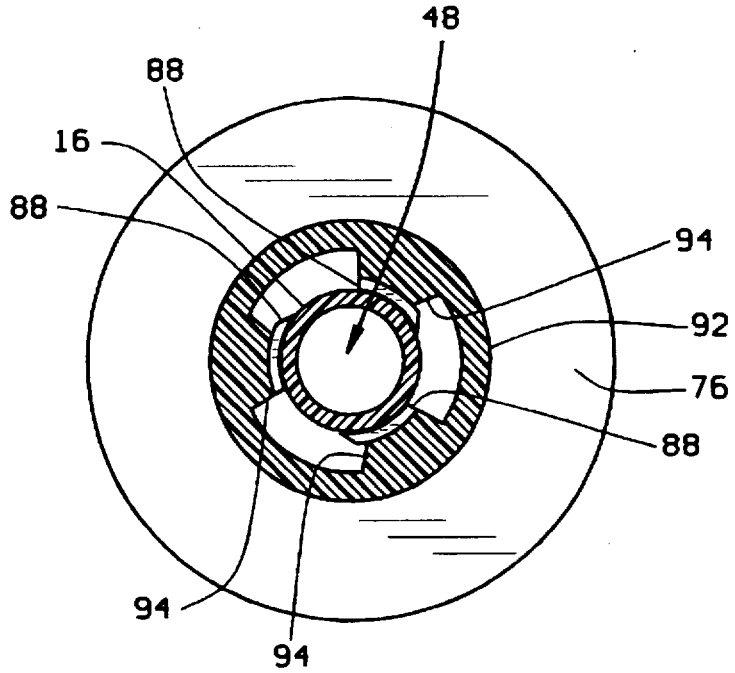
FIG. 4 is a cross section of the lock mechanism of FIG. 1 shown in its locked condition.

Three leaf springs 86 project upwardly from the lock base 74. The leaf springs are spatially arranged around the lock base 74 and the plunger 16 as is best seen in FIGS. 3 and 4. At the top of each leaf spring is a pawl 88. The leaf springs are resilient and bias the pawls radially away from the plunger exterior surface and out of engagement with the plunger.

A cylindrical knob 92 extends upwardly from the lock ring collar 84. The cylindrical knob has a generally cylindrical interior surface with three cams 94 spatially arranged and projecting radially inwardly from the interior surface. The positioning of the cams is best seen in FIGS. 3 and 4. On rotation of the lock ring 76 relative to the lock base 74, the cams 94 come into engagement with the leaf springs 86 and pawls 88 of the lock base, pushing the leaf springs and pawls radially inwardly so that the pawls engage against the exterior surface of the plunger 16. FIG. 4 shows the knob 92 rotated to the position relative to the lock base 74 where the cams 94 engage the leaf springs 86 and pawls 88 and push them radially inwardly so that the pawls engage the exterior surface of the plunger 16. In this position of the pawls relative to the plunger, the pawls will engage against the upper annular shoulder 52 of the plunger when the plunger is in its inwardly inserted, discharge position relative to the pump housing, and prevent the plunger from moving to its upwardly extended, charge position relative to the housing. Alternatively, with the plunger in its upwardly extended, charge position, the engagement of the pawls 88 against the exterior surface of the plunger 16 and against the lower annular shoulder 54 will prevent the plunger from being moved to its downwardly inserted, discharge position relative to the pump housing. In this manner, the lock mechanism 18 can be selectively, manually operated to lock the plunger in either its downwardly inserted, discharge position or its upwardly extended, charge position relative to the pump housing 14. On rotation of the lock ring 76 relative to the look base 74 so that the cams 94 move out of engagement with the leaf springs 86 and pawls 88 as shown in FIG. 3, the plunger is free to reciprocate through its full stroke movement between its inwardly inserted, discharge position and its outwardly extended, charge position relative to the pump housing 14.

When the plunger 16 is locked in its downwardly inserted, discharge position relative to the pump housing 14, the sealing plug 58 seats over and closes the liquid inlet opening 34 at the top of the pump column 32, thereby sealing closed the pump and preventing leakage of liquid through the pump. When the plunger is locked in its upwardly extended, charge position relative to the pump housing, the seal ring 68 of the piston 66 is pushed downwardly by the inner most lower annular flange 78 of the lock base 74 and engages around the top surface of the sealing plug 58. The seal band 72 engages over the outlet openings 62 in the plunger and seals closed communication between the pump chamber 28 and the plunger interior bore 48 preventing leakage of liquid through the pump.

Figure 5:
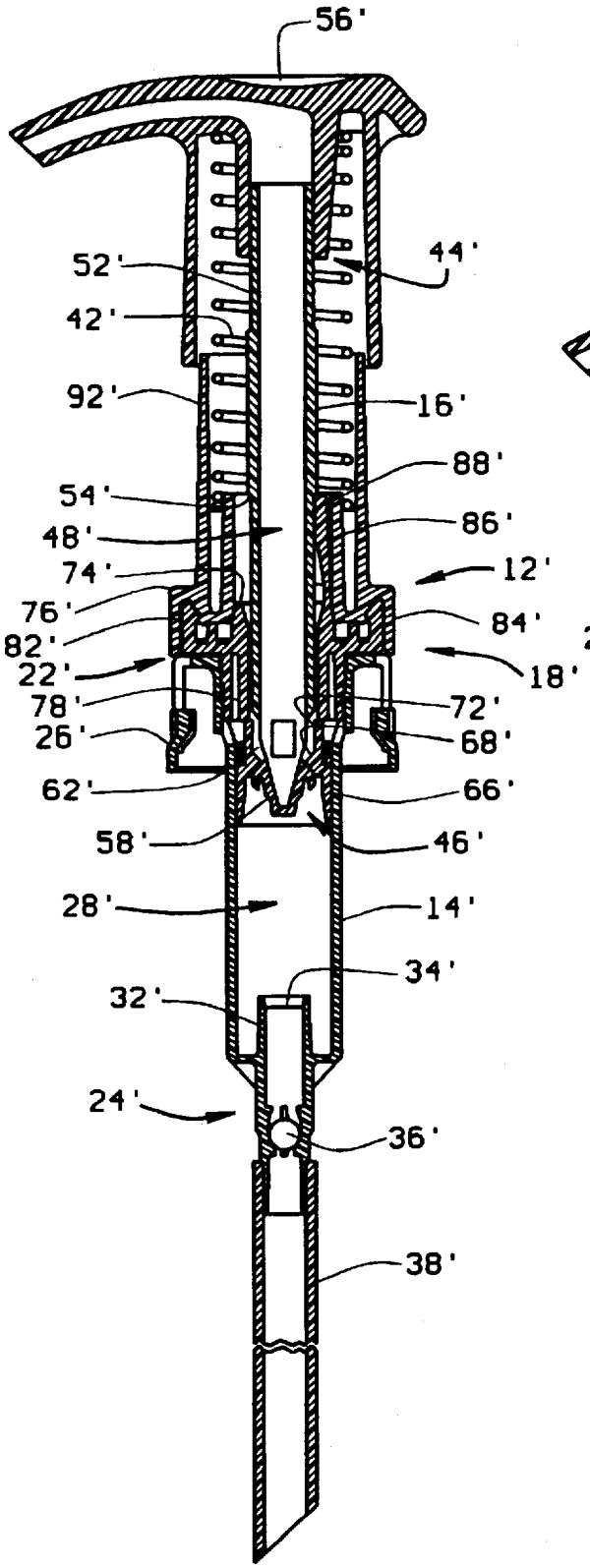
FIG. 5 is an in section elevation view of a second embodiment of the pump in its upwardly extended, charge position.
Figure 6:
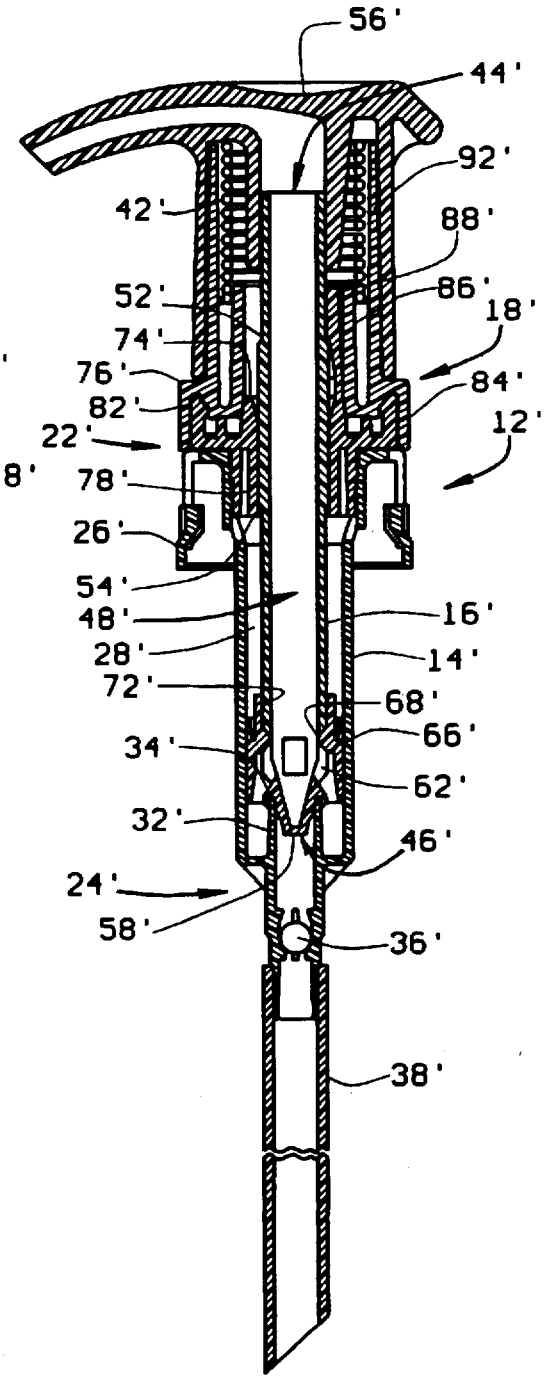
FIG. 6 is an in section elevation view of the pump of FIG. 5 shown in its inwardly inserted, discharge position.

FIGS. 5 and 6 show a second embodiment of the pump of the invention having substantially the same features as the first embodiment. The second embodiment of the pump employs the same lock mechanism 18' and the same seal ring 68' and sealing plug 58' as the first embodiment of the invention. The locking mechanism and sealing ring and plug function in the same manner as the first embodiment of the invention. The only difference between the construction of the pump shown in FIGS. 5 and 6 and that shown and described earlier with reference to FIGS. 1–4 is that the coil spring 96 is positioned outside the fluid flow path through the pump. With this positioning of the coil spring, it does not inhibit the free flow of liquid through the pump. The spring functions in the same manner as that of the previously described embodiment in biasing the plunger 16' to its upwardly extended, charge position relative to the pump housing 14'.

While the present invention has been described by reference to specific embodiments, it should be understood that modifications and variations of the invention may be constructed without departing from the scope of the invention defined in the following claims.

What is claimed is:

1. A manually operable reciprocating liquid pump comprising:

a pump housing having a pump chamber;

a piston mounted in the pump chamber for reciprocating movement therein between a discharge position and a charge position of the piston in the pump chamber;

a piston rod connected to the piston for moving the piston in the pump chamber, the piston rod having a discharge shoulder and a charge shoulder spaced from each other on the piston rod; and, a lock on the pump housing that is selectively operable to engage with the discharge shoulder and lock the piston in the discharge position in the pump chamber, and engage with the charge shoulder and lock the piston in the charge position in the pump chamber.

2. The pump of claim 1, wherein:

a liquid inlet opening communicates with the pump chamber and conducts liquid into the pump chamber in response to the piston moving to the charge position, an outlet opening communicates with the pump chamber and conducts liquid out of the pump chamber in response to the piston moving to the discharge position, and means are provided on the piston rod for closing the inlet opening when the piston is moved to the discharge position and for closing the outlet opening when the piston is moved to the charge position.

3. The pump of claim 2, wherein:

the means for closing the inlet opening includes a plug connected to the piston rod, the plug being shaped to seat over and close the inlet opening when the piston is moved to the discharge position.

4. The pump of claim 2, wherein:

the means for closing the outlet opening includes a seal connected to the piston rod, the seal is shaped to seat over and close the outlet opening when the piston is moved to the charge position.

5. The pump of claim 4, wherein:

the piston rod has an interior bore extending therethrough and the outlet opening passes through the piston rod and communicates with the interior bore for conducting liquid out of the pump chamber and into the interior bore in response to the piston moving to the discharge position.

6. The pump of claim 5, wherein:

the means for closing the inlet opening includes a plug connected to the piston rod, the plug being shaped to seat over and close the inlet opening when the piston is moved to the discharge position.

7. The pump assembly of claim 1, wherein:

the lock includes a pawl that is selectively movable into engagement with the piston rod where the pawl slides over the piston rod on reciprocation of the piston in the pump chamber and engages with the discharge shoulder with the piston in the discharge position and engages with the charge shoulder with the piston in the charge position, and is selectively movable out of engagement with the piston rod where the pawl does not engage with the discharge shoulder or the charger shoulder on reciprocation of the piston in the pump chamber between the discharge position and the charge position.

8. The pump assembly of claim 7, wherein:

the pawl is mounted on the pump housing by a spring that biases the pawl away from the piston rod.

9. The pump assembly of claim 1, wherein:

the discharge shoulder and the charge shoulder are annular shoulders that extend completely around the piston rod; and, the lock includes a plurality of pawls that are spatially arranged around the piston rod and that are selectively movable into engagement with the piston rod where the pawls slide over the piston rod on reciprocation of the piston in the pump chamber and engage with the discharge shoulder when the piston is in the discharge position and engage with the charge shoulder when the piston is in the charge position, and are selectively movable out of engagement with the piston rod where the pawls do not engage with the discharge shoulder or the charge shoulder on reciprocation of the piston in the pump chamber between the discharge position and the charge position.

10. The pump assembly of claim 9, wherein:

each of the pawls is mounted on the pump housing by a spring that biases the pawl away from the piston rod.

11. The pump assembly of claim 1, wherein:

a spring biases the piston toward the charge position and the spring is positioned outside the pump chamber.

12. A manually operated reciprocating liquid pump comprising:

a pump housing having a tubular configuration with an interior bore extending through the pump housing;

a plunger received in the pump housing bore for reciprocating stroke movements of the plunger therein between a bottom stroke position and an upwardly spaced top stroke position of the plunger in the pump housing interior bore, the plunger having a tubular configuration with an interior bore extending through the plunger and the plunger having an exterior surface with a radially projecting lower shoulder and an upwardly spaced, radially projecting upper shoulder; and a manually operable lock on the pump housing that is selectively operable to engage with the lower shoulder and lock the plunger in the top stroke position and engage with the upper shoulder and lock the plunger in the bottom stroke position.

13. The pump of claim 12, wherein:

the lock includes a pawl that is selectively movable radially toward and away from the plunger exterior surface.

14. The pump of claim 12, wherein:

the plunger exterior surface has a consistent exterior diameter between the upper and lower shoulders.

15. The pump of claim 14, wherein:

the lock includes a pawl that is selectively movable radially toward the plunger exterior surface where the pawl slides over the exterior surface on reciprocation of the plunger in the pump housing and engages over the lower shoulder with the plunger in the top stroke position and engages over the upper shoulder with the plunger in the bottom stroke position, and is selectively movable away from the plunger exterior surface where the pawl does not engage with the lower shoulder or upper shoulder on reciprocation of the plunger in the pump housing between the top stroke and bottom stroke positions.

16. The pump of claim 15, wherein:

a spring biases the pawl away from engagement with the plunger exterior surface.

17. The pump assembly of claim 12, wherein:

the pump housing has an orifice in its interior bore that provides fluid communication with the pump housing interior bore through the orifice, and the plunger has a plug on a lower end of the plunger that is shaped to seat in and close the orifice when the plunger is moved to the bottom stroke position.

18. The pump assembly of claim 12, wherein:

the plunger has a valve on the plunger that closes the plunger interior bore when the plunger is moved to the top stroke position and opens the plunger interior bore when the plunger is moved to the bottom stroke position.

19. The pump assembly of claim 17, wherein:

the plunger has a valve on the plunger that closes the plunger interior bore when the plunger is moved to the top stroke position and opens the plunger interior bore when the plunger is moved to the bottom stroke position.

20. The pump assembly of claim 12, wherein:

the lower shoulder and the upper shoulder are annular shoulders that extend completely around the plunger.

21. The pump assembly of claim 12 wherein:

a spring biases the plunger toward the top stroke position and the spring is positioned outside the pump chamber.

22. A manually operable reciprocating liquid pump comprising:

a pump housing having a pump chamber;

a piston mounted in the pump chamber for reciprocating movement therein between a discharge position and a charge position of the piston in the pump chamber;

an inlet opening communicating with the pump chamber to conduct liquid into the pump chamber in response to the piston moving to the charge position;

an outlet opening communicating with the pump chamber to conduct liquid out of the pump chamber in response to the piston moving to the discharge position; and means in the pump chamber for closing the inlet opening when the piston is moved to the discharge position and for closing the outlet opening when the piston is moved to the charge position.

23. The pump of claim 22, wherein:

a piston rod is connected to the piston for moving the piston in the pump chamber; and the means for closing the inlet opening includes a plug connected to the piston rod, the plug is shaped to seat over and close the inlet opening when the piston is moved to the discharge position.

24. The pump of claim 22, wherein:

a piston rod is connected to the piston for moving the piston in the pump chamber; and the means for closing the outlet opening includes a seal connected to the piston rod, the seal is shaped to seat over and close the outlet opening when the piston is moved to the charge position.

25. The pump of claim 23, wherein:

the means for closing the outlet opening includes a seal connected to the piston rod, the seal is shaped to seat over and close the outlet opening when the piston is moved to the charge position.

26. The pump of claim 25, wherein:

the piston rod has an interior bore extending therethrough and the outlet opening passes through the piston rod and communicates with the interior bore for conducting liquid out of the pump chamber and into the interior bore in response to the piston moving to the discharge position.

27. The pump of claim 26, wherein:

the means for closing the inlet opening includes a plug connected to the piston rod, the plug being shaped to seat over and close the inlet opening when the piston is moved to the discharge position.

28. The pump of claim 22, wherein:

a piston rod is connected to the piston for moving the piston in the pump chamber;

the piston rod has a discharge shoulder and a charge shoulder spaced from each other on the piston rod; and, a lock is mounted on the pump housing and is selectively operable to engage with the discharge shoulder and lock the piston in the discharge position in the pump chamber, and engage with the charge shoulder and lock the piston in the charge position in the pump chamber.

29. The pump of claim 28, wherein:

the lock includes a pawl that is selectively movable into engagement with the piston rod where the pawl slides over the piston rod on reciprocation of the piston in the pump chamber and engages with the discharge shoulder with the piston in the discharge position and engages with the charge shoulder with the piston in the charge position, and is selectively movable out of engagement with the piston rod where the pawl does not engage with the discharge shoulder or the charger shoulder on reciprocation of the piston in the pump chamber between the discharge position and the charge position.

30. The pump of claim 22, wherein:

a spring biases the piston toward the charge position and the spring is positioned outside the pump chamber.

* * * * *